US012638266B2

(12) United States Patent
Gore

(10) Patent No.: US 12,638,266 B2
(45) Date of Patent: May 26, 2026

(54) AIR GUN ASSEMBLY AND A PIN FOR FILLING AND BLEEDING A PRESSURE TUBE ASSEMBLY

(71) Applicant: Air Venturi Ltd., Solon, OH (US)

(72) Inventor: Thomas Gore, Pinckney, MI (US)

(73) Assignee: Air Venturi Ltd., Solon, OH (US)

( * ) Notice: Subject to any disclaimer, the term of this patent is extended or adjusted under 35 U.S.C. 154(b) by 0 days.

(21) Appl. No.: 19/011,302

(22) Filed: Jan. 6, 2025

(65) Prior Publication Data

US 2026/0002756 A1 Jan. 1, 2026

Related U.S. Application Data

(60) Provisional application No. 63/664,382, filed on Jun. 26, 2024.

(51) Int. Cl.

| | |
|---|---|
| ***F41B 11/723*** | (2013.01) |
| ***F41B 11/684*** | (2013.01) |
| ***F41B 11/73*** | (2013.01) |

(52) U.S. Cl.

CPC ..... *F41B 11/723* (2013.01); *F41B 11/684* (2013.01); *F41B 11/73* (2013.01)

(58) Field of Classification Search

CPC ..... F41B 11/73; F41B 11/723

See application file for complete search history.

(56) References Cited

U.S. PATENT DOCUMENTS

| | | | | |
|---|---|---|---|---|
| 4,282,852 | A * | 8/1981 | Omana | F41B 11/683 124/67 |
| 4,709,686 | A | 12/1987 | Taylor et al. | |
| 5,193,517 | A | 3/1993 | Taylor et al. | |
| 5,365,493 | A * | 11/1994 | Harrison | G01V 1/137 251/63 |
| 9,404,707 | B2 | 8/2016 | Gore | |
| 11,859,939 | B2 * | 1/2024 | St. Phillips | F41B 11/646 |
| 2010/0031944 | A1 * | 2/2010 | Maeda | F41B 11/723 124/74 |
| 2020/0378717 | A1 | 12/2020 | Gore | |

OTHER PUBLICATIONS

European Patent Office, Extended European Search Report issued in corresponding Application No. 25159401.6 dated Oct. 16, 2025.

* cited by examiner

*Primary Examiner* — Michelle Clement

(74) *Attorney, Agent, or Firm* — Stites & Harbison, PLLC; David W. Nagle, Jr.

(57) ABSTRACT

An air gun assembly includes a gun tube and a pressure tube assembly. The gun tube defines a first aperture. The pressure tube assembly includes a fill block and a cylinder coupled to each other. The fill block defines a second aperture and the cylinder defines a chamber configured to contain compressed gas. The air gun assembly includes a pin disposed through the first aperture and the second aperture to couple together the fill block and the gun tube. The pin defines a channel. The air gun assembly also includes a valve assembly attached to the pin and at least partially disposed inside of the channel. The valve assembly is configured to selectively allow fluid communication into the chamber via the channel.

21 Claims, 4 Drawing Sheets

AIR GUN ASSEMBLY AND A PIN FOR FILLING AND BLEEDING A PRESSURE TUBE ASSEMBLY

CROSS-REFERENCE TO RELATED APPLICATIONS

This application claims priority to, and the benefit of, U.S. Provisional Patent Application No. 63/664,382, filed on Jun. 26, 2024, the disclosure of which is hereby incorporated by reference in its entirety.

BACKGROUND

An air gun is a rifle, pistol, etc., which utilizes compressed gas to fire a projectile. Air guns may be powered by, for example, a coil-spring assembly or a gas-spring assembly. For a gas-spring arrangement, a piston is moved toward a trigger to compress a gas or air behind the piston. When the trigger is released, the piston is driven forward by the compressed gas thereby compressing the air in front of the piston to discharge the projectile out of a barrel.

For some uses, it may be desirable to be able to control or adjust an amount of pressure of the compressed gas which may, for example, change a velocity of the projectile discharged out of the barrel.

SUMMARY

The present disclosure provides an air gun assembly including a gun tube and a pressure tube assembly. The gun tube defines a first aperture. The pressure tube assembly includes a fill block and a cylinder coupled to each other. The fill block defines a second aperture and the cylinder defines a chamber configured to contain compressed gas. The air gun assembly includes a pin disposed through the first aperture and the second aperture to couple together the fill block and the gun tube. The pin defines a channel. The air gun assembly also includes a valve assembly attached to the pin and at least partially disposed inside of the channel. The valve assembly is configured to selectively allow fluid communication into the chamber via the channel.

The present disclosure also provides for a pin for an air gun assembly. The air gun assembly includes a gun tube and a pressure tube assembly. The gun tube defines a first aperture. The pressure tube assembly includes a fill block and a cylinder coupled to each other. The fill block defines a second aperture and the cylinder defines a chamber configured to contain compressed gas. The pin includes a housing configured to couple together the gun tube and the pressure tube assembly via the first aperture and the second aperture. The housing defines a channel. The pin includes a valve assembly attached to the pin and at least partially disposed inside of the channel. The valve assembly is configured to selectively allow fluid communication into the chamber via the channel.

The detailed description and the drawings or figures are supportive and descriptive of the disclosure, but the claim scope of the disclosure is defined solely by the claims. While some of the best modes and other configurations for carrying out the claims have been described in detail, various alternative designs and configurations exist for practicing the disclosure defined in the appended claims.

Figure 1:
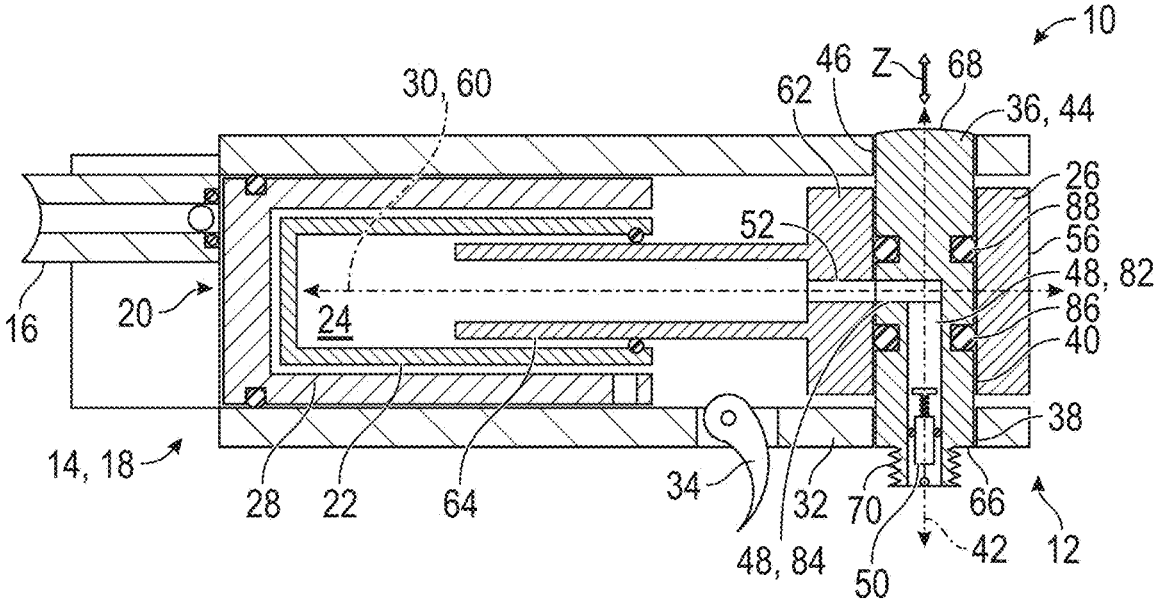
FIG. 1 is a schematic partial cross-sectional view of an air gun assembly including a pin of a first configuration.

The present disclosure may be extended to modifications and alternative forms, with representative configurations shown by way of example in the drawings and described in detail below. Inventive aspects of the disclosure are not limited to the disclosed configurations. Rather, the present disclosure is intended to cover modifications, equivalents, combinations, and alternatives falling within the scope of the disclosure as defined by the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the figures to aid the reader's understanding, and do not represent limitations (for example, to the position, orientation, or use, etc.) on the scope of the disclosure, as defined by the appended claims. Moreover, terms such as "first," "second," "third," and so on, may be used to describe separate components. Such terminology may include the words specifically mentioned above, derivatives thereof, and words of similar import. Furthermore, the term "substantially" can refer to a slight imprecision or slight variance of a condition, quantity, value, or dimension, etc., some of which are within manufacturing variance or tolerance ranges.

As used herein, an element or step recited in the singular and preceded by the word "a" or "an" should be understood as not necessarily excluding the plural of the elements or steps. That is, "a", "an", "the", "at least one", and "one or more" are used interchangeably to indicate that at least one of the items is present and more than one may be present, unless stated otherwise. Further, any reference to "one configuration" is not intended to be interpreted as excluding the existence of additional configurations that also incorporate the recited features. Moreover, unless explicitly stated to the contrary, configurations "comprising" or "having" an element or a plurality of elements having a particular property may include additional elements not having that property. The phrase "at least one of" as used herein should be construed to include the non-exclusive logical "or", i.e., A and/or B and so on depending on the number of components.

The features in the figures are not shown to scale.

Figure 6:
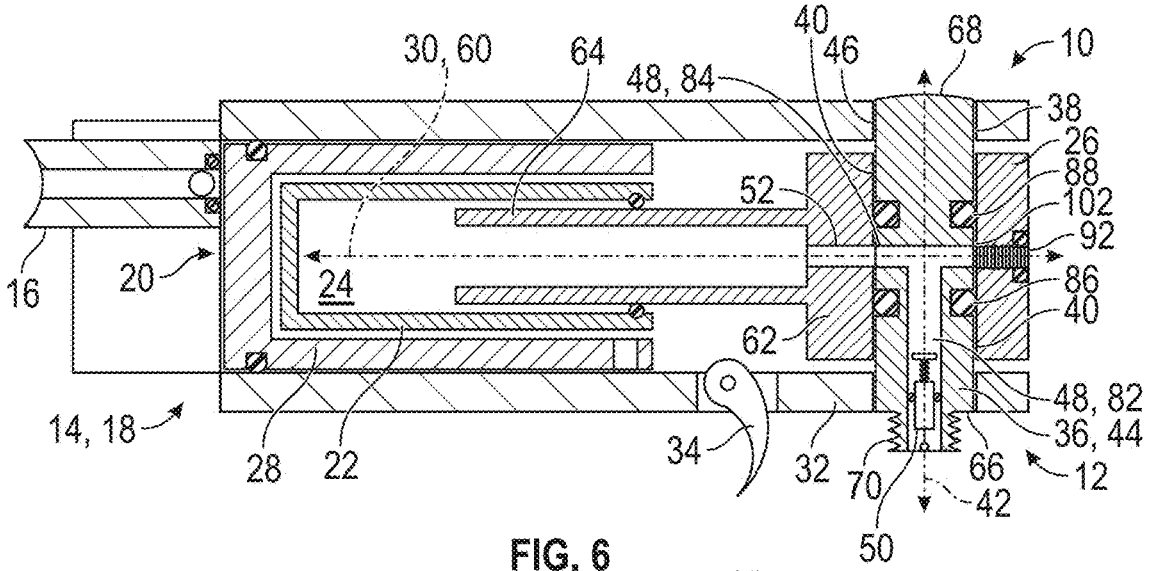
FIG. 6 is a schematic partial cross-sectional view of the air gun assembly including a pin of another configuration, with the lock removed.
Figure 9:
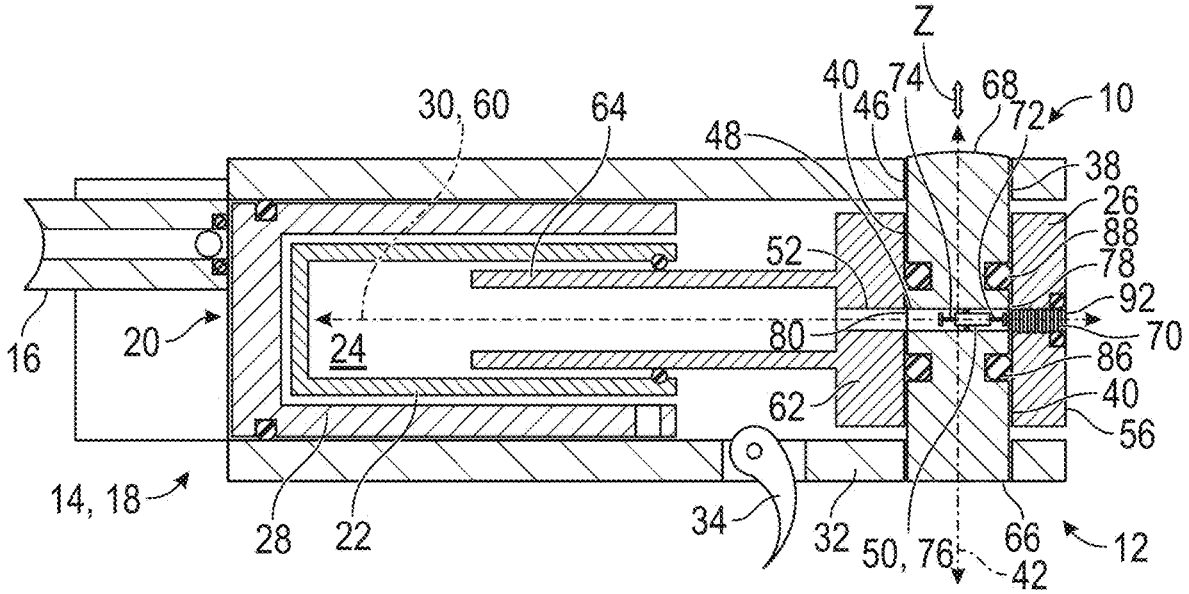
FIG. 9 is a schematic partial cross-sectional view of the air gun assembly including a pin of another configuration.

Referring to the figures, wherein like numerals indicate like or corresponding parts throughout the several views, an air gun assembly 10 is generally shown in FIGS. 1, 6, and 9.

The air gun assembly 10 may include a stock, a gun tube 32, a trigger assembly 12, a pressure tube assembly 14, and a barrel 16. The gun tube 32 may house various components of the air gun, for example, may house at least part of the pressure tube assembly 14 and/or may house at least part of the trigger assembly 12. The air gun utilizes a burst of pressurized gas or compressed gas to fire a projectile out of the barrel 16.

The stock may include any suitable size and/or shape, and may be configured as a rifle or a pistol stock. The stock may include and be manufactured from any suitable material, such as a wood material, a plastic material, a composite material, or some other material capable of supporting the components of the air gun during use, while permitting easy manufacture of the stock.

Turning to the pressure tube assembly 14, the pressure tube assembly 14 may include any structure having a hollow tubular member containing a pressurized fluid, such as, but not limited to, compressed or pressurized gas including but not limited to air or any other suitable gas. For example, the pressure tube assembly 14 may be configured as, but is not limited to, a gas-spring assembly 18.

Generally, the stock may support the pressure tube assembly 14 that defines a pressure chamber 20 that houses the gas-spring assembly 18. The gas-spring assembly 18 may include a cylinder 22 defining a chamber 24 configured to contain the compressed gas. Therefore, the cylinder 22 may also be referred to as a compression cylinder. The pressure tube assembly 14 includes a fill block 26 to refill the chamber 24 with the compressed gas, which will be discussed further below.

The pressure chamber 20 is in fluid communication with the barrel 16. The barrel 16 is pivotably attached to the stock between a ready-firing position and a cocking position. A lever interconnects the barrel 16 and the gas-spring assembly 18. Movement of the barrel 16 from the ready-firing position into the cocking position moves the lever, which in turn moves the gas-spring assembly 18 from an uncompressed position into a compressed position. Once the barrel 16 is moved back into the ready-firing position, the air gun is ready to fire.

The gas-spring assembly 18 may also include a piston 28 that is movable along a center axis 30 relative to the stock. Generally, the piston 28 is disposed inside the pressure chamber 20. The piston 28 may be movable axially or slidably disposed along the center axis 30. The piston 28 is movable between the uncompressed position and the compressed position.

In certain configurations, the cylinder 22 may be disposed inside the piston 28. The cylinder 22 may be fixed to the piston 28 such that the piston 28 and the cylinder 22 move axially concurrently along the center axis 30 between the uncompressed position and the compressed position, or alternatively, the cylinder 22 may be coupled to the piston 28 such that the piston 28 is movable independently of the cylinder 22 between the uncompressed position and the compressed position (and optionally the cylinder 22 may also be movable). When using the cylinder 22, the cylinder 22 of the gas-spring assembly 18 may be filled with the compressed gas.

The gas-spring assembly 18 is configured to compress the pressurized/compressed gas within the piston 28, or within the cylinder 22 if using the cylinder 22, in response to movement of the piston 28 from the uncompressed position into the compressed position. Compression of the gas loads the gas-spring assembly 18 in preparation for firing the projectile.

The trigger assembly 12 may be housed within and/or supported by the stock and/or the pressure tube assembly 14 and/or the gun tube 32. Movement of the barrel 16 from the ready-firing position into the cocking position also moves the trigger assembly 12 from an uncocked position into a cocked position. The cocked position is generally associated with a ready to fire position, and the uncocked position is generally associated with a post firing, i.e., not-ready to fire position. These positions apply to all of the configurations discussed herein.

The trigger assembly 12 may include any trigger components utilized to fire a weapon. Generally, the trigger assembly 12 may include a trigger block, a trigger 34 movably coupled to the trigger block, and a sear which is operated via the trigger 34 through a mechanical connection.

When the barrel 16 is in the ready-firing position, the gas is compressed in the gas-spring assembly 18 (in the compressed position), and the trigger assembly 12 is in the cocked position, then the air gun is ready for firing. When firing the air gun, the trigger 34 is pulled and actuation of the trigger assembly 12 releases the gas-spring assembly 18, which allows the gas-spring assembly 18 to decompress. Decompression of the gas-spring assembly 18 compresses the air contained within the pressure chamber 20, which fires the projectile out of the barrel 16.

Referring to FIGS. 1, 6, and 9, the air gun assembly 10 also includes a pin 36 to couple or attach various components of the air gun together. For example, the pin 36 may couple the trigger assembly 12 and the stock together, and/or may couple the trigger assembly 12 to the pressure tube assembly 14 and/or may couple the trigger assembly 12 to the gun tube 32.

Continuing with FIGS. 1, 6, and 9, the pressure tube assembly 14 includes the fill block 26 and the cylinder 22 coupled to each other. The fill block 26 may be implemented to provide a path to fill and bleed the chamber 24 of the cylinder 22 that contains the compressed gas. The pin 36 is designed to cooperate with the fill block 26 to fill and bleed the chamber 24 of the cylinder 22. That is, the pin 36 described herein may control or adjust an amount of pressure of the compressed gas in the cylinder 22 which may, for example, change a velocity of the projectile discharged out of the barrel 16.

Hence, the pin 36 described herein provides a dual function of coupling or attaching various components of the air gun together, as well as provides a way to control or adjust the amount of pressure in the chamber 24 of the cylinder 22. Each of these functions of the pin 36 are described further below.

Continuing with FIGS. 1, 6, and 9, the gun tube 32 defines a first aperture 38, and the fill block 26 defines a second aperture 40. More specifically, the gun tube 32 may include a gun housing defining a cavity that houses various components of the air gun. Generally, the first aperture 38 extends through a plurality of sides of the gun tube 32 and the various components are housed inside of the sides of the gun tube 32. In the figures, the first aperture 38 extends through two sides of the gun tube 32. The gun housing may define the first aperture 38 that extends through two or more sides of the gun housing. The pin 36 is disposed through the first aperture 38 and the second aperture 40 to couple together the fill block 26 and the gun tube 32. More specifically, the gun tube 32 is pinned to the fill block 26 such that these components are stationary relative to the movable parts of the air gun.

In certain configurations, the first aperture 38 and the second aperture 40 are disposed axially along a central axis 42. The central axis 42 may be transverse to the center axis 30 of the movement of the piston 28. Optionally, the central axis 42 and the center axis 30 may be substantially perpendicular to each other.

Turning to FIGS. 1, 3, 4, 6, 8, and 9, the pin 36 includes a housing 44 configured to couple together the gun tube 32 and the pressure tube assembly 14 via the first aperture 38 and the second aperture 40. The pin 36 includes an outer surface 46 which engages the gun tube 32 and the fill block 26 within the respective first aperture 38 and the second aperture 40 to couple or connect together the gun tube 32 and the fill block 26. Therefore, the outer surface 46 of the pin 36 may at least partially complement at least a portion of the gun tube 32 within the first aperture 38 and at least a portion of the fill block 26 within the second aperture 40. It is to be appreciated that the pin 36 may be any suitable outer configuration to obtain the desired connection between the gun tube 32 and the fill block 26. Optionally, the pin 36 may be threadedly connected to the gun tube 32 to secure the pin 36 in a desired position/orientation relative to the gun tube 32. For example, the outer surface 46 of the pin 36 may be threaded to present external threads and the gun tube 32 inside of the first aperture 38 may be threaded to present internal threads, and the external threads and the internal threads cooperate to provide the desired threaded connection.

As the air gun is operated, the pressure in the chamber 24 decreases, and as desired, the chamber 24 will need to be repressurized or refilled with compressed gas. In addition, sometimes it is desirable to change the velocity of the projectile discharged out of the barrel 16. The pin 36 is designed to provide a passage to refill the chamber 24. Therefore, continuing with FIGS. 1, 3, 4, and 6-9, the pin 36 defines a channel 48, and more specifically, the housing 44 of the pin 36 defines the channel 48. The channel 48 generally creates the passage through the pin 36 which may be implemented to fill the chamber 24, and optionally, bleed the chamber 24 in certain configurations. The channel 48 may be any suitable configuration, including length, diameter(s), orientation, etc., and the figures illustrate some non-limiting examples, which will be described with each configuration below.

Referring to FIGS. 1, 4, 6, 8, and 9, the air gun assembly 10 also includes a valve assembly 50 attached to the pin 36 and at least partially disposed inside of the channel 48 of the pin 36. The valve assembly 50 is configured to selectively allow fluid communication into the chamber 24 via the channel 48. The valve assembly 50 is omitted in FIG. 3 to illustrate other features, but it is to be appreciated that any of the illustrated valve assemblies 50 of the other figures would be disposed in the pin 36 of FIG. 3.

The valve assembly 50 is activated or actuated to control or adjust an amount of pressure of the compressed gas in the chamber 24 of the cylinder 22 which may, for example, change a velocity of the projectile discharged out of the barrel 16. Therefore, the valve assembly 50 allows the air gun to operate at different velocity outputs which may reflect different projectile weights and/or idiosyncrasy of different air guns in different altitudes, etc. The chamber 24 of the cylinder 22 of the gas-spring assembly 18 may be filled with the compressed gas, or optionally, in certain configurations, the compressed gas may be bled, via the valve assembly 50.

Referring to FIGS. 1, 2, and 4-7, the fill block 26 defines a pathway 52 that intersects the second aperture 40 at a first access point 54. Also, the fill block 26 defines an outside surface 56 spaced radially away from the central axis 42, and the pathway 52 intersects the outside surface 56 at a chamber access point 58. Therefore, the pathway 52 extends to the first access point 54 and the chamber access point 58 within the fill block 26. Generally, the pathway 52 is disposed transverse to the central axis 42. In certain configurations, the pathway 52 extends axially along a longitudinal axis 60, and the longitudinal axis 60 is transverse to the central axis 42. In certain configurations, the central axis 42 and the longitudinal axis 60 are substantially perpendicular to each other. The pathway 52 is in fluid communication with the chamber 24 of the cylinder 22 at the chamber access point 58. The pathway 52 may be continuously in fluid communication with the chamber 24 of the cylinder 22.

Figure 2:
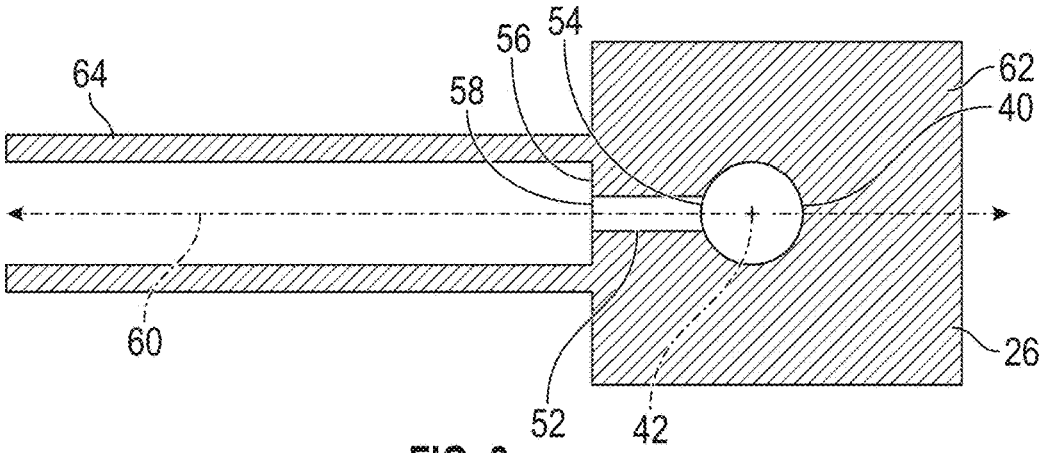
FIG. 2 is a schematic cross-sectional view of a component of a pressure tube assembly from FIG. 1, in which the component includes a fill block of FIG. 1.
Figure 3:
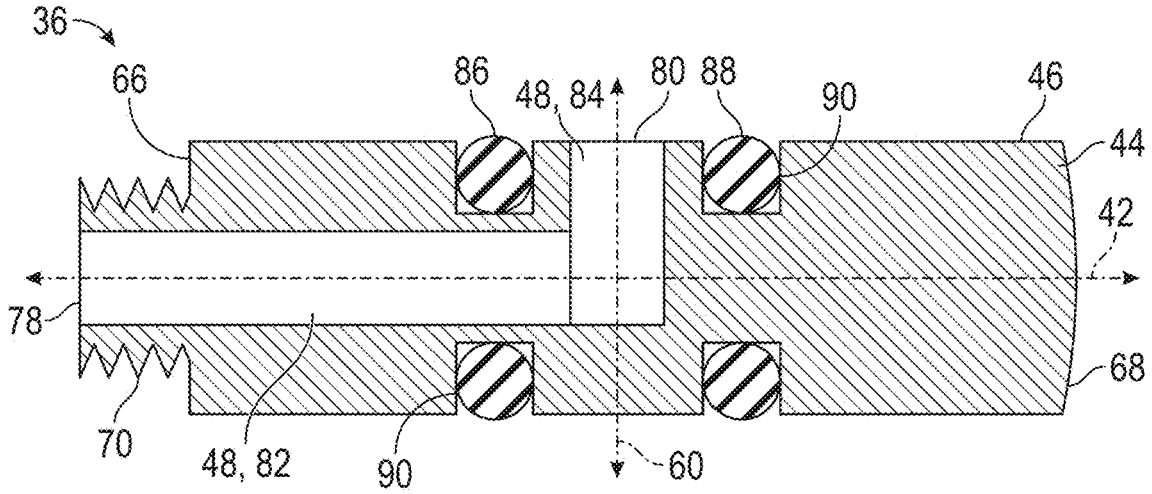
FIG. 3 is a schematic cross-sectional view of the pin of FIG. 1 with a valve assembly removed.
Figure 5:
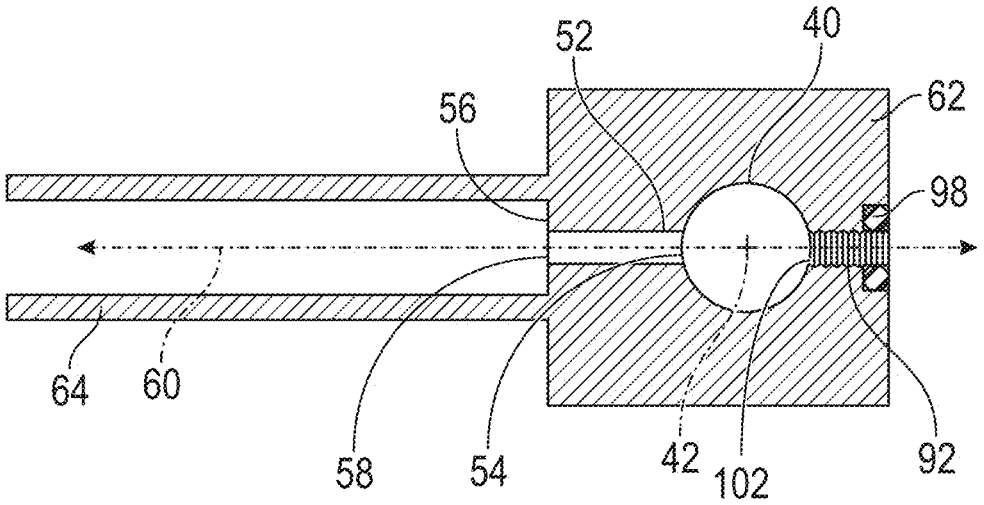
FIG. 5 is a schematic cross-sectional view of a modification of the component of FIG. 2, in which the fill block is modified to cooperate with the lock of FIGS. 4, 6, and 7.

Referring to FIGS. 2 and 5, the fill block 26 includes a central body 62 and a tube 64 extending from the central body 62. The tube 64 extends into the chamber 24 and the chamber access point 58 accesses the chamber 24 inside of the tube 64. In addition, the central body 62 may define the second aperture 40, and thus, the pin 36 is housed in the central body 62 of the fill block 26.

The pin 36, and more specifically the housing 44 of the pin 36, may include a first distal end 66 and a second distal end 68 spaced apart from each other axially along the central axis 42. In addition, the pin 36, and thus the housing 44 of the pin 36, may include the outer surface 46 disposed between the first distal end 66 and the second distal end 68. The outer surface 46 of the housing 44 may be spaced radially away from the central axis 42. The first distal end 66 and the second distal end 68 may be accessible from outside of the air gun, and may be disposed along opposing sides of the stock. The channel 48 extends through the pin 36 in various orientations, depending on the desired fill location. That is, the channel 48 of the pin 36 may intersect the outer surface 46 and one of the first distal end 66 and the second distal end 68 (see FIGS. 1, 3, 4, and 6-8); or, the channel 48 of the pin 36 may intersection the outer surface 46 without intersecting either of the first distal end 66 and the second distal end 68 (see FIG. 9).

Therefore, for example as shown in FIGS. 1, 3, 4, and 6-8, to fill and/or bleed the chamber 24, the first distal end 66 or the second distal end 68 may include a nozzle attachment portion 70 and the channel 48 extends through the nozzle attachment portion 70. As another example, as shown in FIG. 9, to fill and/or bleed the chamber 24, the nozzle attachment portion 70 may be incorporated into the central body 62 of the fill block 26 instead of the pin 36. Generally, the nozzle attachment portion 70 is open to the atmosphere, and thus, is accessible outside of the air gun to provide a location to fill the chamber 24, and optionally bleed the chamber 24.

A fluid dispenser is attached to the nozzle attachment portion 70 to deliver the gas to the chamber 24. The fluid dispenser may be attached to the nozzle attachment portion 70 of the pin 36 via any suitable methods to transfer the gas into the chamber 24. For example, the nozzle attachment portion 70 may have threads (internal threads or external threads) that cooperate with threads of the fluid dispenser or any other suitable methods such as a quick release coupler, etc. may be used to attach together the nozzle attachment portion 70 and the fluid dispenser. For example, if utilizing threads to connect the fluid dispenser to the nozzle attachment portion 70, one non-limiting example of the threaded connection may be about 0.305-32 threads per inch. Optionally, the fluid dispenser may include a pump, such as a portable pump or a hand pump. When the fluid dispenser is a pump, the pump may be a high-pressure pump to provide the desired fluid pressure to inject the gas into the chamber 24.

Generally, the valve assembly 50 is disposed proximal to the nozzle attachment portion 70. In all of the configurations herein, the valve assembly 50 allows the chamber 24 to be filled via the nozzle attachment portion 70. Hence, when the fluid dispenser is attached to the nozzle attachment portion 70, the valve assembly 50 opens to deliver the gas into the chamber 24. When filling is completed, the valve assembly 50 closes and then the fluid dispenser may be detached from the pin 36.

Referring to FIGS. 1, 4, and 6-9, the valve assembly 50 may include a movable portion 72 configured to move to a closed position blocking fluid flow through the channel 48 and an open position opening fluid flow through the channel 48. The movable portion 72 may be continuously biased to the closed position via a biaser 74, such as a spring, or any other suitable biasing member. In certain configurations, the movable portion 72 may be a plunger, a plug, or any other suitable member to open and close fluid flow through the channel 48.

Various features of the valve assembly 50 are discussed below. It is to be appreciated that other valve assemblies 50, not explicitly discussed herein, may be used. As non-limiting examples, the valve assembly 50 may include a plunger design, a ball design, a Schrader valve design, a Presta valve design, etc., and these valve assembly 50 configurations each cooperate with the pin 36 as described herein. As one non-limiting example, when the valve assembly includes a Schrader valve, the threaded connection may be about 0.305-32 threads per inch between the nozzle attachment portion 70 and the pump of the fluid dispenser.

For illustrative purposes, the valve assembly 50 may include a valve housing 76 attached to the pin 36 relative to the channel 48, and the valve housing 76 defines a bore and the movable portion 72 selectively closes the bore to selectively allow fluid communication from outside of the pin 36, through the bore, and into the chamber 24. The biaser 74 may be disposed inside or outside of the bore and may react against a surface of the valve housing 76 to continuously bias the movable portion 72 to the closed position. In certain configurations, the valve housing 76 may be threadedly connected to the pin 36 to secure the valve assembly 50 to the pin 36. For example, the valve housing 76 may be threaded to present external threads and the pin 36 inside of the channel 48 may be threaded to present internal threads, and the external threads and the internal threads cooperate to provide the desired threaded connection.

Optionally, the valve assembly 50 may also be used to bleed the chamber 24. Therefore, a tool or any other suitable structure may be inserted inside of the nozzle attachment portion 70 to engage the movable portion 72 to move the movable portion 72 to the open position to bleed some of the gas out of the chamber 24, which exits the chamber 24 via the nozzle attachment portion 70. Any of the configurations herein may optionally bleed the chamber 24 via the valve assembly 50.

The channel 48 of the pin 36 may extend through the pin 36 in any suitable direction, and non-limiting examples are discussed next. Turning to FIGS. 1, 3, 4, and 6-9, generally, the channel 48 includes a first outlet 78 and a second outlet 80 spaced apart from each other. In certain configurations, as shown in FIGS. 1, 3, 4, and 6-8, the channel 48 may turn inside of the pin 36. The first outlet 78 may intersect the first distal end 66 or the second distal end 68 of the pin 36. More specifically, the first outlet 78 of the channel 48 may be disposed axially along the central axis 42, and the second outlet 80 may be disposed transverse to the central axis 42. Generally, the second outlet 80 may intersect the outer surface 46 of the housing 44 of the pin 36.

Turning to FIG. 9, in certain configurations, the channel 48 may extend through the outer surface 46 of the pin 36. More specifically, the first outlet 78 and the second outlet 80 may intersect the outer surface 46 of the housing 44 of the pin 36. In certain configurations, the channel 48, including the first outlet 78 and the second outlet 80, may be disposed axially along the longitudinal axis 60.

Continuing with FIGS. 1, 3, 4, and 6-8, in certain configurations, the channel 48 may include a first channel segment 82 disposed axially along the central axis 42 and a second channel segment 84 disposed transverse to the central axis 42. The first outlet 78 may be disposed along the first channel segment 82 and the second outlet 80 may be disposed along the second channel segment 84. In certain configurations, the first channel segment 82 intersects the first distal end 66 or the second distal end 68 to define the first outlet 78 disposed axially along the central axis 42.

Generally, the valve assembly 50 is attached to the pin 36 along the first channel segment 82. More specifically, in certain configurations, the movable portion 72 is housed via the pin 36 along the first channel segment 82. The movable portion 72 may be configured to move to the closed position blocking fluid communication through the first channel segment 82 and the open position opening the first channel segment 82 to allow fluid communication between the first outlet 78 and the second outlet 80.

Continuing with FIGS. 1, 3, 4, and 6-8, generally, a first seal 86 and a second seal 88 each surround the outer surface 46 of the housing 44 of the pin 36, and the first seal 86 and the second seal 88 are spaced from each other. The first seal 86 and the second seal 88 may be attached to the pin 36, and more specifically, attached to the housing 44 of the pin 36. In certain configurations, the first seal 86 and the second seal 88 are disposed in respective recesses 90 around the outer surface 46 of the pin 36 to attach the respective seals 86, 88 to the housing 44 of the pin 36. Generally, the second outlet 80 is disposed between the first seal 86 and the second seal 88. In certain configurations, the second channel segment 84 is disposed between the first seal 86 and the second seal 88 relative to the longitudinal axis 60, and additionally, the first channel segment 82 is disposed between the first seal 86 or the second seal 88 relative to the central axis 42. Turning to FIG. 9, the channel 48, including the first outlet 78 and the second outlet 80 are disposed between the first seal 86 and the second seal 88. The first seal 86 and the second seal 88 are disposed in respective recesses 90 around the outer surface 46 of the pin 36. The first seal 86 and the second seal 88 minimize or prevent gas leaks between the pin 36 and the fill block 26 during filling and operation of the air gun.

Referring to FIG. 1, in this configuration, the pin 36 may be movable independently of the fill block 26 to an initial position and a displaced position to selectively bleed the chamber 24. The first seal 86 and the second seal 88 cooperate to minimize or prevent gas leaks out of the chamber 24 when the pin 36 is in the initial position; that is, the first seal 86 and the second seal 88 prevent gas leaks between the pin 36 and the fill block 26 during filling and operation of the air gun. Therefore, the pin 36 may be movable along the central axis 42 to the initial position in which the second outlet 80 and the first access point 54 of the pathway 52 are disposed between the first seal 86 and the second seal 88 such that the first access point 54 and the second outlet 80 are in fluid communication with each other. In addition, the pin 36 may be movable along the central axis 42 to the displaced position in which the first seal 86 and the second seal 88 are both disposed to one side of the first access point 54 of the pathway 52 such that the pathway 52 bypasses the channel 48 and bleeds fluid out of the chamber 24 via the second aperture 40 of the fill block 26. In this configuration, when the pin 36 is in the displaced position, the gas may bleed out of the chamber 24 via flowing through the pathway 52 and out the second aperture 40 of the fill block 26 and then the first aperture 38 of the gun tube 32 to outside of the air gun. That is, this configuration allows an alternative way to bleed the gas out of the chamber 24 without using the valve assembly 50. As such, for this configuration, there are two different ways to bleed the chamber 24, i.e., via movement of the pin 36 along arrow Z and via operation of the valve assembly 50. For example, the pin 36 is shown in the initial position in FIG. 1 and the arrow Z in FIGS. 1, 4, and 9 represents the directions that the pin 36 may move to the displaced position to bleed the chamber 24 by bypassing the channel 48 of the pin 36.

Turning to FIGS. 4-7, optionally, the fill block 26 may define an opening 92 transverse to the central axis 42, and in certain configurations, the opening 92 is defined through the outside surface 56 of the fill block 26 and intersects the second aperture 40 to access the second aperture 40. Generally, the opening 92 is spaced apart from the pathway 52. The opening 92 may be implemented to perform a couple different operations, as discussed below.

Figure 4:
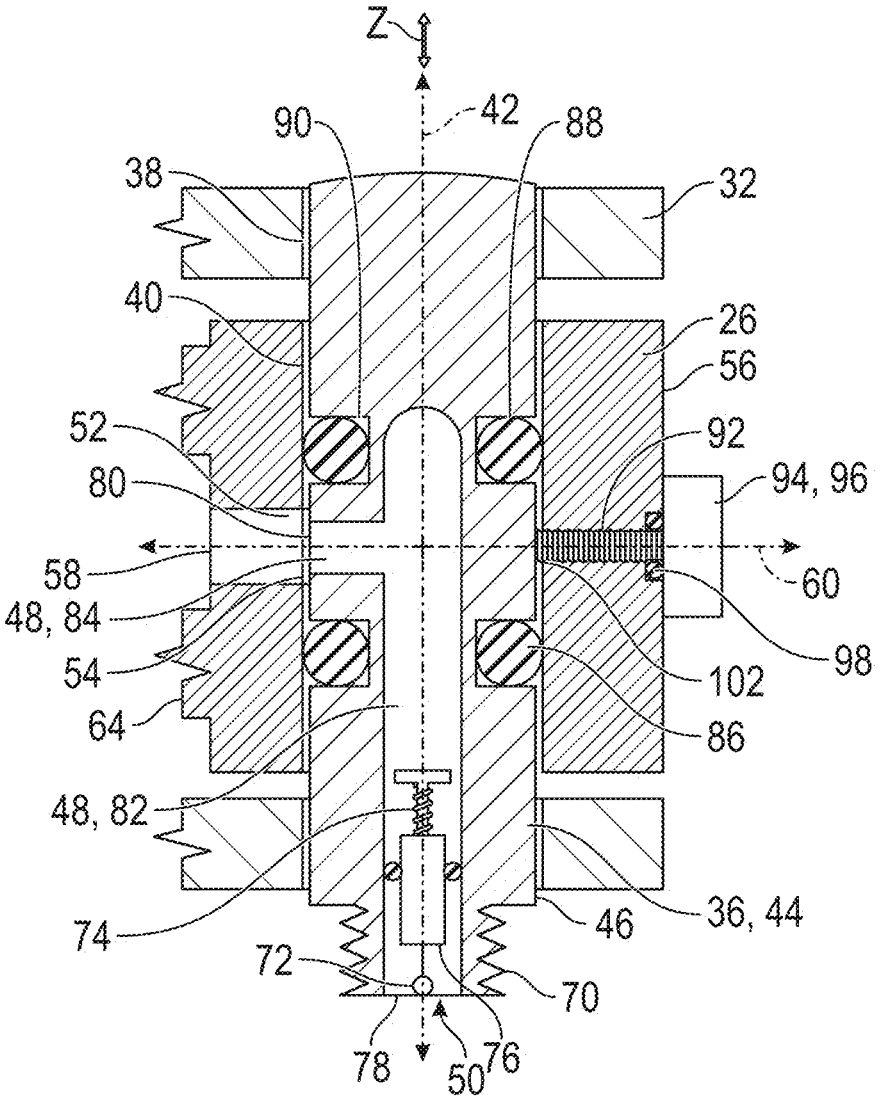
FIG. 4 is a schematic fragmented cross-sectional view of a fill block modified to cooperate with a lock.

Referring to FIGS. 4-7, a lock 94 may be coupled to the fill block 26 via the opening 92. The lock 94 may be implemented to fix the pin 36 in the initial position for the configuration where the pin 36 is movable relative to the first aperture 38 and the second aperture 40. The lock 94 may be movable between a locked position engaging the pin 36 to fix the pin 36 relative to the fill block 26 in the initial position and an unlocked position disengaged from the pin 36 to allow the pin 36 to move relative to the fill block 26 axially along the central axis 42 to the displaced position. As shown in FIG. 4, the lock 94 may engage or abut the outer surface 46 of the pin 36 to lock 94 the pin 36 in place.

The opening 92 may be threaded and the lock 94 may have complementary threads to secure the lock 94 to the fill block 26. The lock 94 may include a knob 96 to grasp and/or move the lock 94 to the locked position and the unlocked position. Therefore, the knob 96 is accessible outside of the air gun. Optionally, a third seal 98 may be disposed between the fill block 26 and the knob 96 to minimize or prevent gas leaks out of the fill block 26 relative to the outside surface 56 of the fill block 26. Regardless of whether the lock 94 is implemented for the configuration of FIG. 9, the opening 92 may be implemented as the nozzle attachment portion 70 to cooperate with the fluid dispenser to fill the chamber 24, as shown in FIG. 9. For the configuration of FIG. 9, there are two different ways to bleed the chamber 24, i.e., via accessing the opening 92, via operation of the valve assembly 50, and via movement of the pin 36 along arrow Z.

When utilizing the lock 94, to move the pin 36 to the displaced position, the lock 94 is moved to the unlocked position and a force is applied to the pin 36, which allows the pin 36 to move along the central axis 42 (the arrow Z in FIG. 4 represents the directions of movement of the pin 36). Once the pin 36 is moved back to the initial position, the lock 94 may be moved back to the locked position which again fixes the pin 36 relative to the fill block 26.

Figure 7:
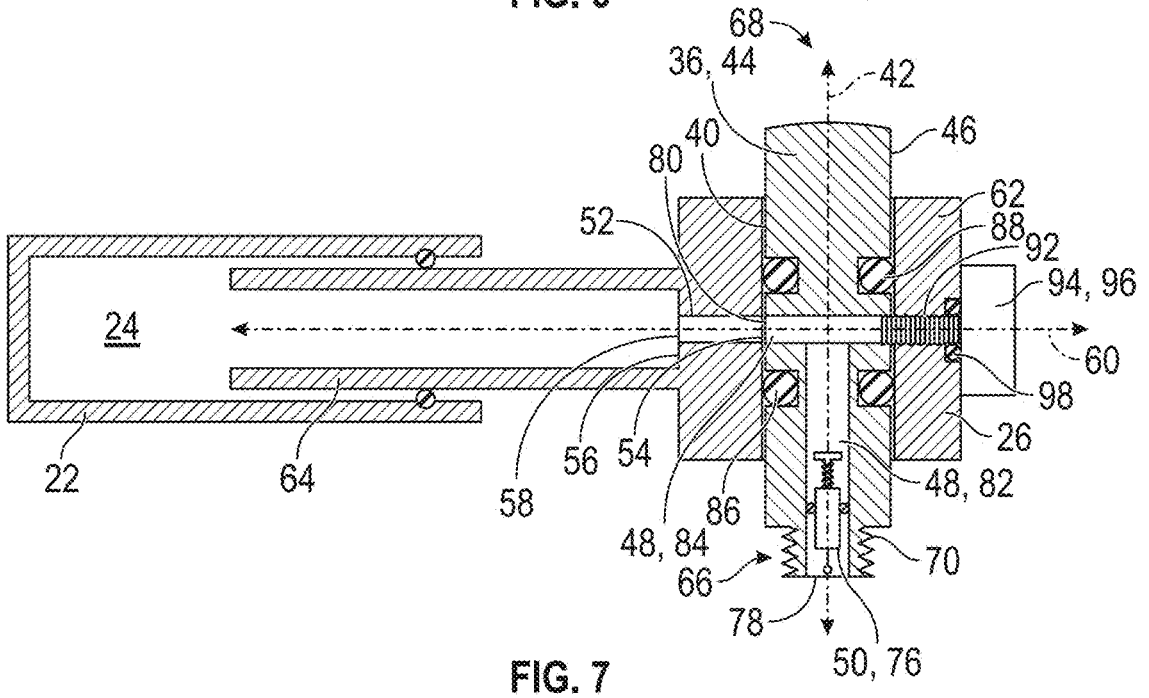
FIG. 7 is a schematic cross-sectional view of components of the pressure tube assembly from FIG. 6, in which one of the components includes the fill block of FIG. 5 and the pin of FIG. 6, and the lock illustrated.
Figure 8:
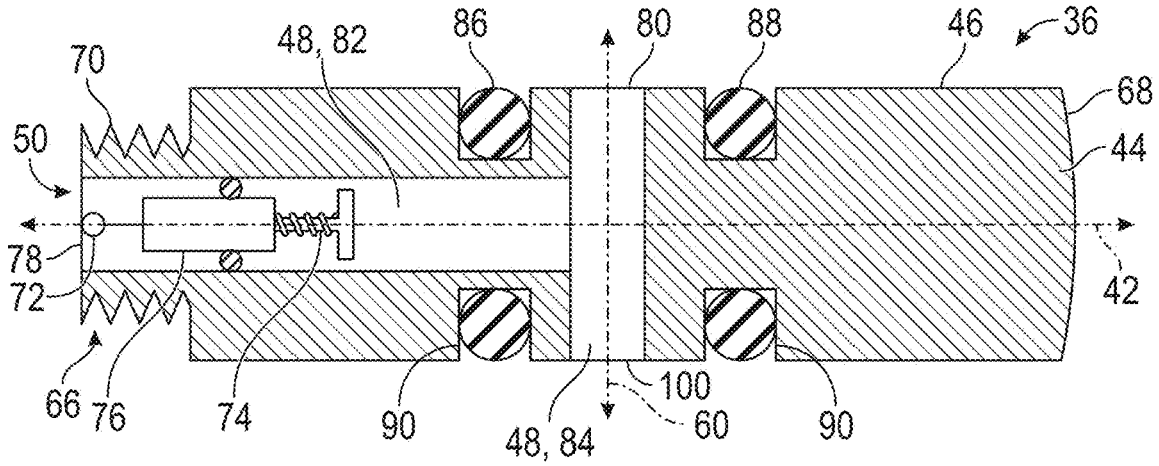
FIG. 8 is a schematic cross-sectional view of the pin of FIG. 6.

Turning to FIGS. 6-8, the second channel segment 84 intersects the outer surface 46 of the pin 36 to define the second outlet 80 and a third outlet 100 spaced apart from each other. Said differently, the second channel segment 84 intersects the outer surface 46 at the second outlet 80 and at the third outlet 100 spaced apart from the second outlet 80. Generally, the second outlet 80 and the third outlet 100 are disposed between the first seal 86 and the second seal 88. That is, the second channel segment 84, including the second outlet 80 and the third outlet 100, are disposed between the first seal 86 and the second seal 88 relative to the longitudinal axis 60.

Continuing with FIGS. 6-8, the opening 92 of the fill block 26 is spaced apart from the pathway 52 and the opening 92 intersects the second aperture 40 at a second access point 102. In this configuration, the second outlet 80, the first access point 54 of the pathway 52, and the second access point 102 of the opening 92 are disposed between the first seal 86 and the second seal 88. Generally, the pathway 52, the second channel segment 84, and the opening 92 are in fluid communication with each other. In certain configurations, the pathway 52, the second channel segment 84 and the opening 92 are axially aligned with each other along the longitudinal axis 60 transverse to the central axis 42.

Continuing with FIGS. 6-8, the lock 94 is coupled to the fill block 26 via the opening 92. In this configuration, the lock 94 is movable between a locked position engaging the pin 36 at the third outlet 100 to block fluid communication out of the third outlet 100 and an unlocked position disengaged from the pin 36 to allow fluid communication out of the third outlet 100 to bleed fluid out of the chamber 24 via the second channel segment 84. That is, the lock 94 is partially disposed in the second channel segment 84 via the third outlet 100, which prevents fluid communication through the second channel segment 84 and out of the opening 92 when seated against the outside surface 56 of the fill block 26 and/or against the seal 98. The lock 94 is spaced from the third outlet 100 in the unlocked position to open fluid communication through the second channel segment 84 and out of the opening 92 to bleed fluid out of the chamber 24 via the opening 92. Optionally, the lock 94 of this configuration may also function to fix the pin 36 inside of the second aperture 40 relative to the fill block 26. Therefore, for the configuration of FIGS. 6-8, there are three different ways to bleed the chamber 24, i.e., via accessing the opening 92 through the lock 94, via operation of the valve assembly 50, and via movement of the pin 36 along arrow Z (arrow Z is identified in FIGS. 1 and 4 which represents the directions of movement of the pin 36 for FIGS. 6-8 as well). The knob 96 of the lock 94 of FIG. 7 is accessible outside of the air gun. The lock 94 is removed in FIG. 6 for illustrative purposes, but would be utilized to cooperate with the opening 92 of the fill block 26.

While the best modes and other configurations for carrying out the disclosure have been described in detail, those familiar with the art to which this disclosure relates will recognize various alternative designs and configurations for practicing the disclosure within the scope of the appended claims. Furthermore, the configurations shown in the drawings or the characteristics of various configurations mentioned in the present description are not necessarily to be understood as configurations independent of each other. Rather, it is possible that each of the characteristics described in one of the examples of a configuration can be combined with one or a plurality of other desired characteristics from other configurations, resulting in other configurations not described in words or by reference to the drawings. Accordingly, such other configurations fall within the framework of the scope of the appended claims.

As used herein, a system, apparatus, assembly, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware that enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The illustrations of the configurations described herein are intended to provide a general understanding of the structure of the various configurations. The illustrations are not intended to serve as a complete description of all of the elements and features of apparatus and systems that utilize the structures or methods described herein. Many other configurations may be apparent to those of skill in the art upon reviewing the disclosure. Other configurations may be utilized and derived from the disclosure, such that structural and logical substitutions and changes may be made without departing from the scope of the disclosure. Accordingly, the disclosure and the figures are to be regarded as illustrative rather than restrictive.

What is claimed is:

1. An air gun assembly comprising:

a gun tube defining a first aperture;

a pressure tube assembly including a fill block and a cylinder coupled to each other, wherein the fill block defines a second aperture and the cylinder defines a chamber configured to contain compressed gas;

a pin disposed through the first aperture and the second aperture to couple together the fill block and the gun tube, wherein the pin defines a channel; and a valve assembly attached to the pin and at least partially disposed inside of the channel, wherein the valve assembly is configured to selectively allow fluid communication into the chamber via the channel.

2. The air gun assembly as set forth in claim 1 wherein the fill block defines a pathway that intersects the second aperture at a first access point.

3. The air gun assembly as set forth in claim 2 wherein the first aperture and the second aperture are disposed axially along a central axis, and the pathway is disposed transverse to the central axis.

4. The air gun assembly as set forth in claim 3 wherein the channel includes a first channel segment disposed axially along the central axis and a second channel segment disposed transverse to the central axis, wherein the valve assembly is attached to the pin along the first channel segment.

5. The air gun assembly as set forth in claim 3 wherein:

the pin includes a first distal end and a second distal end spaced apart from each other axially along the central axis;

the first distal end or the second distal end includes a nozzle attachment portion and the channel extends through the nozzle attachment portion; and the valve assembly is disposed proximal to the nozzle attachment portion.

6. The air gun assembly as set forth in claim 5 wherein:

the valve assembly includes a Schrader valve; and the nozzle attachment portion has threads.

7. The air gun assembly as set forth in claim 3:

wherein the channel includes a first outlet disposed axially along the central axis and a second outlet disposed transverse to the central axis;

further including a first seal and a second seal attached to the pin; and wherein the second outlet is disposed between the first seal and the second seal.

8. The air gun assembly as set forth in claim 7 wherein:

the pin is movable independently of the fill block along the central axis to an initial position in which the second outlet and the first access point of the pathway are disposed between the first seal and the second seal such that the first access point and the second outlet are in fluid communication with each other; and the pin is movable independently of the fill block along the central axis to a displaced position in which the first seal and the second seal are both disposed to one side of the first access point of the pathway such that the pathway bypasses the channel and bleeds fluid out of the chamber via the second aperture.

9. The air gun assembly as set forth in claim 8:

wherein the fill block defines an opening transverse to the central axis;

further including a lock coupled to the fill block via the opening; and wherein the lock is movable between a locked position engaging the pin to fix the pin relative to the fill block in the initial position and an unlocked position disengaged from the pin to allow the pin to move relative to the fill block axially along the central axis to the displaced position.

10. The air gun assembly as set forth in claim 4 wherein:

the pin includes a first distal end and a second distal end spaced apart from each other axially along the central axis;

the pin includes an outer surface disposed between the first distal end and the second distal end;

the first channel segment intersects the first distal end or the second distal end to define a first outlet disposed axially along the central axis; and the second channel segment intersects the outer surface of the pin to define a second outlet and a third outlet spaced apart from each other.

11. The air gun assembly as set forth in claim 10:

further including a first seal and a second seal attached to the pin; and wherein the second outlet and the third outlet are disposed between the first seal and the second seal.

12. The air gun assembly as set forth in claim 11 wherein:

the fill block defines an opening spaced apart from the pathway and the opening intersects the second aperture at a second access point; and the second outlet, the first access point of the pathway, and the second access point of the opening are disposed between the first seal and the second seal.

13. The air gun assembly as set forth in claim 12:

further including a lock coupled to the fill block via the opening; and wherein the lock is movable between a locked position engaging the pin at the third outlet to block fluid communication out of the third outlet and an unlocked position disengaged from the pin to allow fluid communication out of the third outlet to bleed fluid out of the chamber via the second channel segment.

14. The air gun assembly as set forth in claim 13 wherein:

the pathway, the second channel segment and the opening are axially aligned with each other along a longitudinal axis transverse to the central axis; and the lock is spaced from the third outlet in the unlocked position to open fluid communication through the second channel segment and out of the opening to bleed fluid out of the chamber via the opening.

15. The air gun assembly as set forth in claim 1 wherein the valve assembly includes a movable portion configured to move to a closed position blocking fluid flow through the channel and an open position opening fluid flow through the channel.

16. The air gun assembly as set forth in claim 15 wherein:

the first aperture and the second aperture are disposed axially along a central axis;

the channel includes a first channel segment disposed axially along the central axis and a second channel segment disposed transverse to the central axis; and the movable portion is housed via the pin along the first channel segment.

17. A pin for an air gun assembly including a gun tube and a pressure tube assembly, wherein the gun tube defines a first aperture and the pressure tube assembly includes a fill block and a cylinder coupled to each other, wherein the fill block defines a second aperture and the cylinder defines a chamber configured to contain compressed gas, wherein the pin comprises:

a housing configured to couple together the gun tube and the pressure tube assembly via the first aperture and the second aperture, wherein the housing defines a channel; and a valve assembly attached to the pin and at least partially disposed inside of the channel, wherein the valve assembly is configured to selectively allow fluid communication into the chamber via the channel.

18. The pin as set forth in claim 17:

wherein the channel includes a first outlet and a second outlet spaced apart from each other;

further including a first seal and a second seal attached to the housing and spaced apart from each other; and wherein the second outlet is disposed between the first seal and the second seal.

19. The pin as set forth in claim 18 wherein:

the housing includes a first distal end and a second distal end spaced apart from each other axially along a central axis;

the housing includes an outer surface spaced radially away from the central axis;

the first seal and the second seal each surround the outer surface of the housing;

the first outlet intersects the first distal end or the second distal end; and the second outlet intersects the outer surface of the housing.

20. The pin as set forth in claim 19 wherein:

the channel includes a first channel segment disposed axially along the central axis and a second channel segment disposed transverse to the central axis;

the first outlet is disposed along the first channel segment;

the second outlet is disposed along the second channel segment; and the valve assembly includes a movable portion configured to move to a closed position blocking fluid communication through the first channel segment and an open position opening the first channel segment to allow fluid communication between the first outlet and the second outlet.

21. The pin as set forth in claim 20 wherein:

the second channel segment intersects the outer surface at the second outlet and at a third outlet spaced apart from the second outlet; and the third outlet is disposed between the first seal and the second seal.

* * * * *